US010486422B2

(12) United States Patent
Urushidani

(10) Patent No.: US 10,486,422 B2
(45) Date of Patent: Nov. 26, 2019

(54) PRINTER AND CONTROL METHOD

(71) Applicant: SEIKO EPSON CORPORATION, Tokyo (JP)

(72) Inventor: Tatsuo Urushidani, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/952,041

(22) Filed: Apr. 12, 2018

(65) Prior Publication Data

US 2018/0297359 A1 Oct. 18, 2018

(30) Foreign Application Priority Data

Apr. 14, 2017 (JP) ..... 2017-080338

(51) Int. Cl.

| | |
|---|---|
| ***B41J 29/38*** | (2006.01) |
| ***B41J 2/12*** | (2006.01) |
| ***B41J 2/125*** | (2006.01) |
| ***B41J 11/00*** | (2006.01) |
| ***B41J 2/205*** | (2006.01) |
| ***B41J 2/21*** | (2006.01) |

(52) U.S. Cl.

CPC ..... *B41J 2/12* (2013.01); *B41J 2/125* (2013.01); *B41J 2/2054* (2013.01); *B41J 2/2139* (2013.01); *B41J 2/2142* (2013.01); *B41J 11/001* (2013.01)

(58) Field of Classification Search

USPC ..... 347/14

See application file for complete search history.

(56) References Cited

U.S. PATENT DOCUMENTS

2007/0046705 A1* 3/2007 Wong ..... B41J 29/393 347/14
2015/0296095 A1 10/2015 Kawafuji et al.
2016/0258813 A1 9/2016 Kuri

FOREIGN PATENT DOCUMENTS

JP 11-211568 A 8/1999
JP 2015-202604 A 11/2015
JP 2016-166865 A 9/2016

* cited by examiner

*Primary Examiner* — Lam S Nguyen
(74) *Attorney, Agent, or Firm* — Foley & Lardner LLP

(57) ABSTRACT

A printer having a printhead configured to print to a print medium; a camera configured to photograph the print medium; a carriage configured to support and move the printhead and the camera; and a processor configured to print, by the printhead, on the print medium a first test pattern that is larger than an imaging area of the camera, photograph the first test pattern by the camera, and detect a printing defect based on a result of the photograph.

12 Claims, 5 Drawing Sheets

PRINTER AND CONTROL METHOD

This application claims priority under 35 U.S.C. § 119 to Japanese Patent Application No. 2017-80338 filed on Apr. 14, 2017, the entire disclosure of which is expressly incorporated by reference herein.

BACKGROUND

1. Technical Field

The present invention relates to a printer capable of detecting printing defects with good precision and making appropriate device adjustments.

2. Related Art

Inkjet printers that print on print media by ejecting ink from ink nozzles are common today. Because such printers are susceptible to printing defects such as blotchy colors due to conditions of the printer, detecting such problems and adjusting the printer accordingly is necessary. In an inkjet printer, the orientation of the nozzles or the amount of ink ejected from the nozzles may be adjusted based on detection of such printing defects.

Such printing defect detection and adjustment is generally done on large format printers when replacing the printheads to minimize maintenance losses.

As a related technology, JP-A-2015-202604 describes an image processing device capable of compensating for uneven print density resulting from variation in ink ejection by different nozzles when using multiple nozzles to print a single raster image.

However, conventional manual methods of detecting and adjusting for printing defects are complicated, time consuming, and labor intensive.

To automate this task, an inspection pattern must be printed and then imaged with a camera, and the printout converted to image data, but if the inspection pattern is not photographed (imaged) appropriately, printing defects cannot be detected with good precision.

Imaging the printed test pattern appropriately to the test pattern is therefore desirable.

SUMMARY

At least one objective of the present invention is to provide a printer capable of appropriately imaging a printed test pattern and detecting printing defects accurately.

A preferred aspect of the invention is a printer having: a printhead configured to print to a print medium; a camera configured to photograph the print medium; a carriage configured to support and move the printhead and the camera; and a processor configured to control to print, by the printhead, on the print medium a first test pattern that is larger than an imaging area of the camera, photograph the first test pattern by the camera, and detect a printing defect based on a result of the photograph.

This aspect of the invention enables imaging the first test pattern with high precision and without adverse effects from the area around the first test pattern, enabling detecting printing defects with good precision.

A printer according to another aspect of the invention preferably also has a light source disposed to the carriage and configured to emit a specific amount of light to an imaging area of the camera; the specific amount of light from the light source being set by the processor so that the maximum amount of light reflected from the first test pattern does not exceed the maximum amount of receivable light the camera can receive.

Further preferably in a printer according to another aspect of the invention, the processor controls to print, by the printhead, a second test pattern at a position separated a specific distance from the first test pattern on the print medium, photographs the second test pattern by the camera, and corrects skewing of the first test pattern based on a result of the photograph.

By correcting skewing of the first test pattern, this aspect of the invention can detect printing defects with great accuracy.

Further preferably in another aspect of the invention, the first test pattern is a specific pattern printed repeatedly, and the second test pattern is a line mark printed at a specific interval.

In another aspect of the invention, part of the first test pattern and the second test pattern are printed by the same pass when the printhead moves in a scanning direction.

This aspect of the invention detect can image skewing and appropriately detect printing defects.

Preferably in another aspect of the invention, the first test pattern is larger than the area illuminated by the light source.

This aspect of the invention suppresses the adverse effects of reflections of light from outside the first test pattern, and thereby can take even more accurate photographs.

Preferably in another aspect of the invention, the processor, identifies a nozzle that is disposed to the printhead and is a cause of the detected printing defect, and adjusts an amount of ink ejected from the nozzle.

This aspect of the invention enables accurately calibrating the device automatically.

Another aspect of the invention is a control method of a printer having a printhead configured to print to a print medium, a camera configured to photograph the print medium, and a carriage configured to support and move the printhead and the camera, the control method including: printing, by the printhead, on the print medium a first test pattern that is larger than an imaging area of the camera; photographing the first test pattern by the camera; and detecting a printing defect based on a result of the photograph.

Other objects and attainments together with a fuller understanding of the invention will become apparent and appreciated by referring to the following description and claims taken in conjunction with the accompanying drawings.

DESCRIPTION OF EMBODIMENTS

Figure 1:
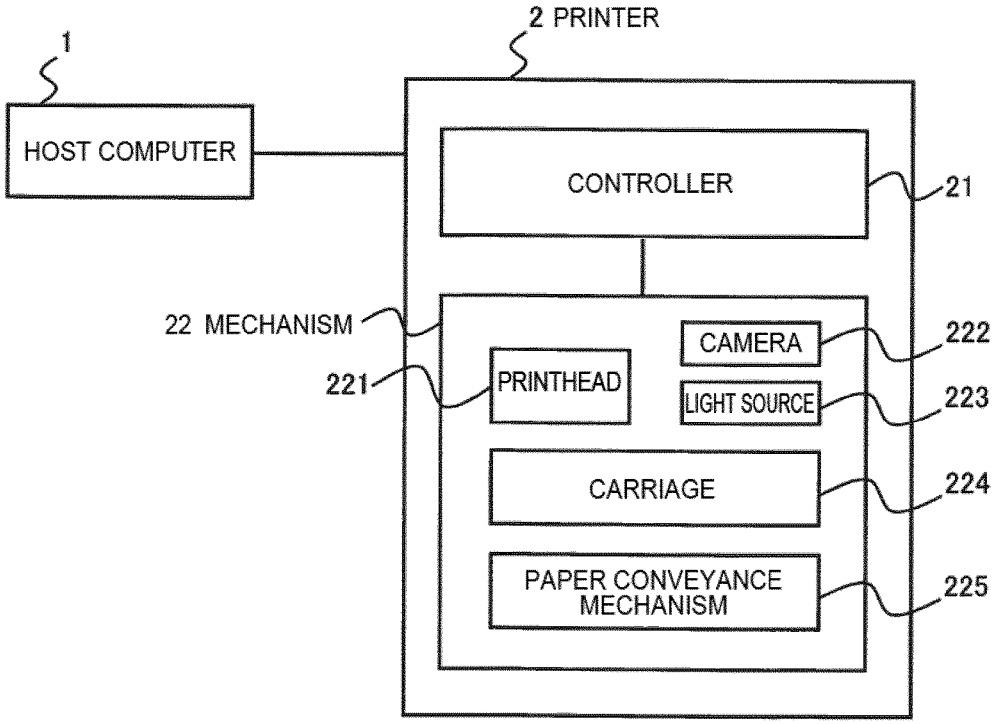
FIG. 1 schematically illustrates the configuration of a printer according to at least one embodiment of the invention.

At least one embodiment of the present invention is described below with reference to the accompanying figures. However, the embodiment described below does not limit the technical scope of the invention. Note that in the figures like or similar parts are identified by the same reference numerals or reference symbols.

FIG. 1 schematically illustrates the configuration of a printer according to at least one embodiment of the invention. The printer 2 shown in FIG. 1 is a printer described as a preferred embodiment of the invention.

This printer 2 has a camera 222 mounted on a carriage 224 that also carries a printhead 221 and moves over the print medium (such as paper M) when printing, and when operating in the inspection mode for detecting blotchy printing and other printing defects, prints a first test pattern M1 (a so-called solid color mark, a graphic produced by repeatedly printing a pattern at a density such that the color of the paper cannot be seen, producing a uniform density image) that is wider (larger) than the imaging area of the camera 222, and detects printing defects based on the result of the camera 222 imaging the first test pattern M1. As a result, the printer 2 can accurately image the first test pattern M1 without being affected by reflection of light from areas around the target image (the first test pattern M1). Because only the first test pattern M1 (a solid color mark) having a similar reflectance of light is present in the imaging area, light emittance can be adjusted appropriately to the first test pattern M1 (the output of the light source 223 can be increased), thereby enabling high precision imaging. Therefore, this printer 2 can detect printing defects with high precision, and as a result enables highly precise device adjustment.

As shown in FIG. 1, the printer 2 according to this embodiment of the invention is a printer configured to print on paper M in response to a print request from a host computer 1, for example, and in one example is a large format inkjet printer used to print advertisements and posters.

As shown in FIG. 1, the printer 2 includes a controller 21 and a mechanism 22.

The controller 21 is a controller that controls other parts of the printer 2, and is embodied by memory storing a program describing the content of a process, and a CPU (processor) that executes processes according to the program. The controller 21 is also configured with RAM or other memory for temporarily storing data during processing, and an ASIC device of logic circuits for executing some processes. The CPU, by reading and running a program stored in ROM, controls the mechanism 22 in various ways.

When print data is received from the host computer 1 through a communication circuit or communication port, for example, in the normal operating mode (printing mode), the controller 21, based on the print data, controls the printhead 221, carriage 224, and paper conveyance mechanism 225 described below to execute the requested printing process on the paper M. When controlling the printhead 221, the controller 21 causes the printhead 221 to eject ink from multiple nozzles of the printhead 221.

As described above, the printer 2 has an inspection mode, and in the inspection mode, the controller 21 controls the mechanism 22 described below to execute processes including printing a test pattern, imaging the test pattern, detecting printing defects based on the imaged test pattern, and making adjustments based on the detection result. The content of the processes in the inspection mode is described below.

The mechanism 22 is controlled by the controller 21, and executes a printing process in the normal mode and an imaging process in the inspection mode. As shown in FIG. 1, the mechanism 22 includes a printhead 221, camera 222, light source 223, carriage 224, and paper conveyance mechanism 225.

Figure 2:
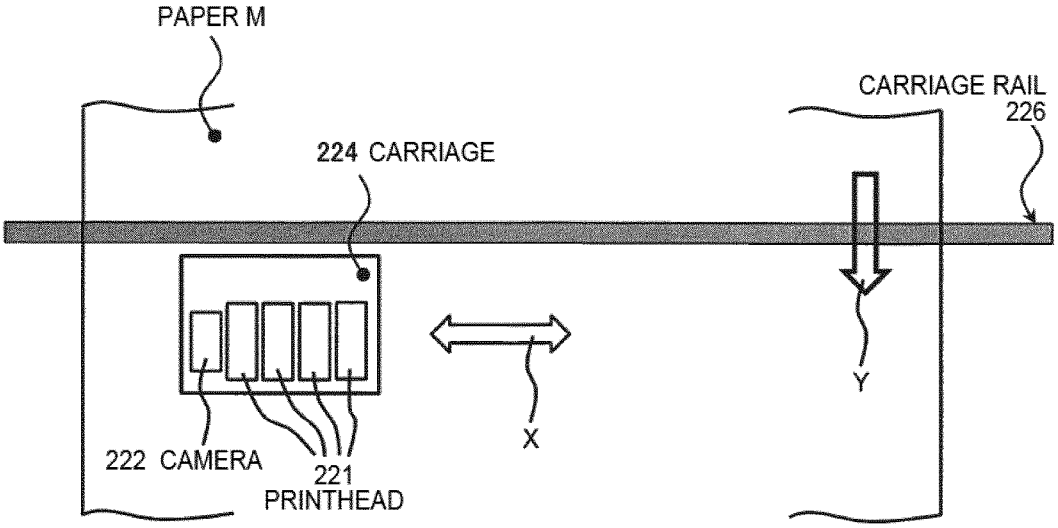
FIG. 2 is a plan view schematically illustrating the mechanism 22 near the carriage 224.

FIG. 2 is a plan view illustrating the mechanism 22 around the carriage 224. The printhead 221 has a plurality of nozzles, and in response to commands from the controller 21, ejects ink from the nozzles onto the paper M, thereby forming and printing images on the paper M.

As shown in FIG. 2, there are multiple printheads 221 on the carriage 224. In one example, when four colors of ink are used, there is a printhead 221 for each color of ink.

The camera 222 is a camera capable of imaging the paper M, which is the print medium, and capturing an image of the image that was printed on the paper M, and as shown in FIG. 2 is carried on the carriage 224. The camera 222, primarily in the inspection mode, images the test pattern that was printed. The camera 222, as controlled by the controller 21, images the test pattern and passes the captured image data to the controller 21. In one example, the camera 222 includes a CMOS sensor or other type of imaging element, and a lens.

The light source 223 provides illumination for imaging by the camera 222, and is disposed near the camera 222. The light source 223 emits light to the subject of the camera 222 (the imaged area), and light output is adjustable. Turning the light source 223 on and off, and adjusting the amount of light emitted is controlled by the controller 21. The light source 223 in this example comprises multiple LED lamps.

The carriage 224 carries the printhead 221, camera 222, and light source 223, and moves them in the scanning direction (indicated by arrow X in FIG. 2). The carriage 224 is driven along a carriage rail 226 by a drive source and power transfer mechanism. The carriage 224 moves as controlled by the controller 21 when printing, for example.

As shown in FIG. 2, when printing, ink is ejected from the printhead 221 moving on the carriage rail 226 in the main scanning direction onto the paper M being conveyed in the sub-scanning direction (in the direction of arrow Y in FIG. 2), and an image is formed on the paper M.

The paper conveyance mechanism 225 is a device that conveys the paper M in the sub-scanning direction, and includes conveyance rollers, a drive source for the rollers, a power transfer mechanism, and a conveyance path. The paper conveyance mechanism 225 is driven as controlled by the controller 21 when printing, for example.

The printer 2 configured as described above according to this embodiment operates in a normal mode and an inspection mode. In the normal mode, the printer 2 receives print requests (print data) from the host computer 1, and in response, the controller 21 controls parts of the mechanism 22 to print on the paper M, which is the print medium. More specifically, the printhead 221 moves in the main scanning direction, ejects ink onto the paper M conveyed in the sub-scanning direction, and forms images. After printing, the paper M is discharged by the paper conveyance mechanism 225.

In the inspection mode, to check the printing condition of the printer 2, processes including printing a test pattern, imaging the test pattern, and detecting printing defects are executed. At least one embodiment of the invention is characterized by the processes of the inspection mode, which are described more completely below.

Figure 3:
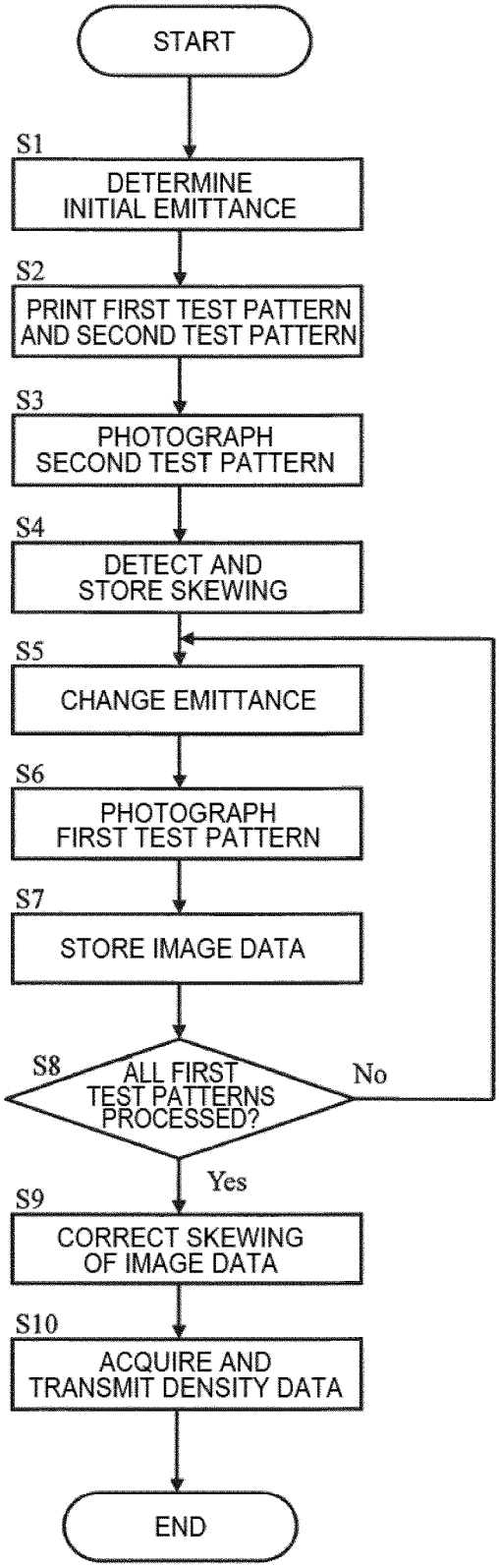
FIG. 3 is a flow chart describing an example of the process executed in the inspection mode.

FIG. 3 is a flow chart of one example of the steps in the inspection mode process. The processes executed by the printer 2 are described based on FIG. 3, but the test patterns that are used in this process are described first.

Two types of test patterns are used in the inspection mode, that is, a first test pattern M1 and a second test pattern M2.

Figure 4:
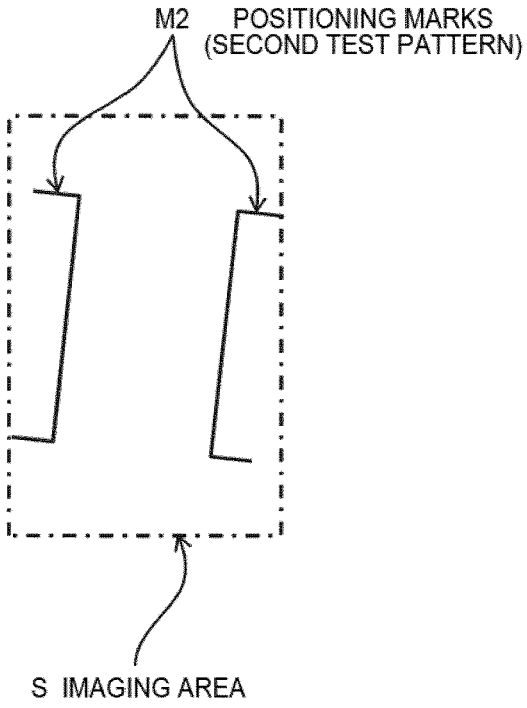
FIG. 4 shows an example of a second test pattern M2 (positioning marks) that is printed.

The second test pattern M2 is a positioning mark. FIG. 4 shows an example of a second test pattern M2 (positioning mark) that is printed. As shown in FIG. 4 the second test pattern M2 has a pair of two line patterns (line images), the longer lines of each (referred to below as the long sides) being parallel to each other. The shorter lines in each (referred to below as the short sides) are perpendicular to the long sides.

The second test pattern M2 is used to correct (adjust) skewing of the printed first test pattern M1. The imaging area S surrounded by the dotted line in FIG. 4 indicates the imaging area that is photographed by the camera 222 after the second test pattern M2 is printed on the paper M. In the process described below, the second test pattern M2 is photographed independently of the first test pattern M1. Therefore, the second test pattern M2 is printed at a position a specific distance from the first test pattern M1.

At least part of the second test pattern M2 and first test pattern M1 may be printed on the same pass when the printhead 221 moves in the main scanning direction. At least part of the second test pattern M2 and first test pattern M1 are printed at positions that are separated a specific distance in the main scanning direction, and are close together in the conveyance direction. As a result, when the camera 222 photographs the second test pattern M2 and first test pattern M1, the distance to be returned in the conveyance direction is short. The number of scans by the camera 222 is also few.

The first test pattern M1 is a solid color mark, and in this example is a rectangle filled to a specific uniform density. A plurality of first test patterns M1 (such as ten) are prepared, and each is filled to a different density. Solid color marks filled to ten different density levels are prepared in this example.

Figure 5:
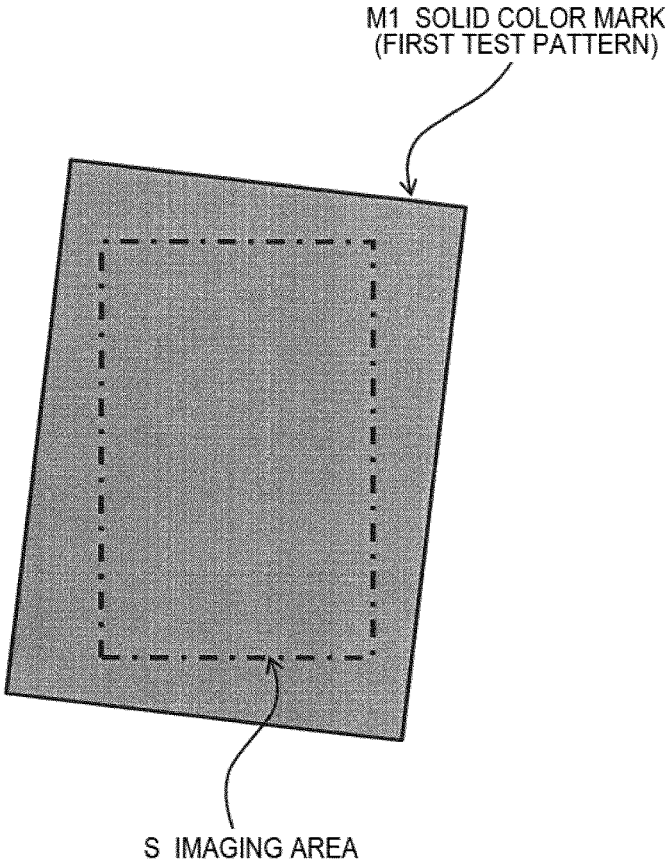
FIG. 5 shows an example of a first test pattern M1 that is printed.

FIG. 5 shows an example of a printed first test pattern M1. The imaging area S enclosed by the dotted linen in FIG. 5 indicates the imaging area that is photographed by the camera 222 after the first test pattern M1 is printed on the paper M. In this way, each of the multiple first test patterns M1 is photographed separately. As shown in FIG. 5, each of the first test patterns M1 is also larger than the imaging area S (covers a larger area).

Note that each first test pattern M1 is preferably larger (covers a larger area) than the area (emittance area) that is illuminated by the light source 223 for imaging.

Furthermore, when imaging each first test pattern M1 with the camera 222, imaging accuracy can be improved by imaging with the amount of light received (for example, the maximum amount of light received when imaging (the maximum amount of light reflected from the first test pattern M1) is approximately 90% of the maximum amount of receivable light) near the maximum amount of light that the camera 222 (image sensor) can receive (referred to below as the maximum amount of receivable light). To enable imaging in this way, the amount of light to be emitted from the light source 223 (referred to below as the emittance) is predetermined for each first test pattern M1.

Because the density in the imaging area S is substantially the same in each first test pattern M1, and the reflectance of light therefore does not change greatly, the amount of light received by the camera 222 can be controlled to near the maximum amount of receivable light by increasing the emittance from the light source 223 to a high density first test pattern M1 where reflectance of light is low compared with emittance to a low density first test pattern M1 where reflectance of light is high.

The emittance level set for each first test pattern M1 is referred to below as the rated emittance level, and each rated emittance level is determined experimentally and is stored in memory of the controller 21. When there are ten first test patterns M1, ten rated emittance levels are stored for each first test pattern M1. Note that because the absolute value of a rated emittance level differs according to the paper M that is used, the absolute value is expressed as a ratio to the rated emittance level of paper M on which nothing is recorded.

The inspection mode is started by a specific user operation of a switch or other operating member of the printer 2, or by transmission of a specific command from the host computer 1.

When the inspection mode starts, the controller 21 first executes an initial emittance determination process (step S1 in FIG. 3). This is a process of determining the rated emittance level of a paper M on which nothing is recorded. More specifically, the controller 21 drives the paper conveyance mechanism 225 to advance the paper M being used at that time to the printing position, and then takes a picture of the paper M with the camera 222 without executing the printing process. The emittance from the light source 223 at this time is a predetermined default level. Next, the controller 21 adjusts the emittance from the light source 223 until the amount of light received by the camera 222 is approximately 90% of the maximum amount of receivable light, and sets the emittance at this time as the initial amount of light.

Next, the controller 21 prints the first test pattern M1 and second test pattern M2 described above (step S2 in FIG. 3). This process is executed in the same way as the printing process in the normal mode. In this process, the second test pattern M2 is printed first, and then at a position separated from the second test pattern M2, each of the multiple first test patterns M1 is printed. The first test pattern M1 and second test pattern M2 that are printed are printed as shown in FIG. 4 and FIG. 5.

Next, the controller 21 images the (image of the) second test pattern M2 printed on the paper M with the camera 222 (step S3 in FIG. 3). The emittance level of the light source 223 for this picture is the initial emittance level determined above. Note that the controller 21 may adjust the emittance level of the light source 223 during imaging from the initial amount of light so that the maximum amount of light received by the camera 222 goes to 90% of the maximum amount of receivable light. Note that the image inside the imaging area S shown in FIG. 4 is imaged in this picture.

The captured image of the second test pattern M2 is sent as image data to the controller 21. Note that the image data is data in which each pixel stores a density gradation value for each color.

The controller 21 acquires the transmitted image data, and based on the image data detects skewing in the printed image (step S4 in FIG. 3).

This skewing is skewing of the printed image to the imaging direction of the camera 222, and while normally there should be no skewing, skewing may result from error (deviation) in the installation of parts during assembly or parts replacement. In the example in FIG. 4, the long sides of the second test pattern M2 and the long sides of the imaging area S should be parallel, but the second test pattern M2 is obviously skewed. The controller 21 can determine skewing of the printed image by image processing the acquired image data, and stores the calculated value (such as the angle) in memory. Skewing of the printed image may also be obtained using the short sides of the second test pattern M2.

Next, the controller 21 executes a process of acquiring image data for the first test patterns M1. The controller 21 executes the following process on each of the multiple images of the first test pattern M1 that were printed.

First, the controller 21 reads the rated emittance level that was determined as described above for the first test pattern M1 to image, and changes the emittance level of the light source 223 to that rated emittance level (step S5 in FIG. 3).

Next, the controller 21 images the (image of the) first test pattern M1 that was printed with the camera 222 at the rated emittance level (step S6 in FIG. 3). The image data of the captured image is then sent from the camera 222 to the controller 21, and the controller 21 stores the image data (step S7 in FIG. 3).

The controller 21 repeats the above steps (S5 to S7) until all first test patterns M1 have been processed (step S8 in FIG. 3: No), and once all first test patterns M1 have been processed (step S8 in FIG. 3: Yes), the process goes to step S9.

The controller 21 executes a process of correcting skewing of the image data stored for the first test patterns M1 (step S9 in FIG. 3). More specifically, the controller 21 reads the value of the skewing that was detected and stored in step S4, and rotates the image data of each image an angle corresponding to the skewing.

Figure 6:
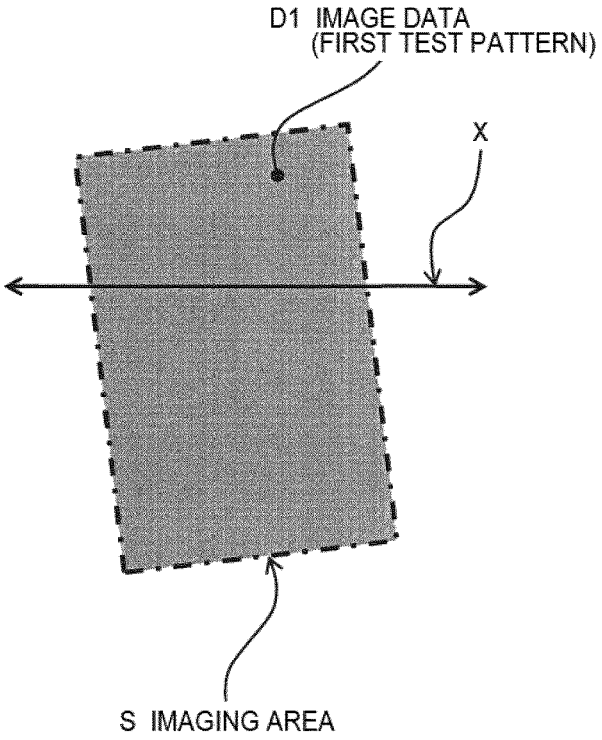
FIG. 6 shows an example of corrected image data D1.

FIG. 6 shows an example of corrected image data D1. In FIG. 6, the image data D1 is image data for one first test pattern M1 that was corrected for skewing. In FIG. 6, arrow X denotes the main scanning direction, and data (pixels) arrayed in that direction is from an image printed by the same nozzles.

Next, the controller 21 acquires density data for each pixel in the analyzed area A in the image data D1 corrected as described above, and sends the data to the part of the controller 21 that controls the printing adjustment function (step S10 in FIG. 3). The part that controls the printing adjustment function may be a separate CPU that handles control of printing, primarily the nozzles.

Figure 7:
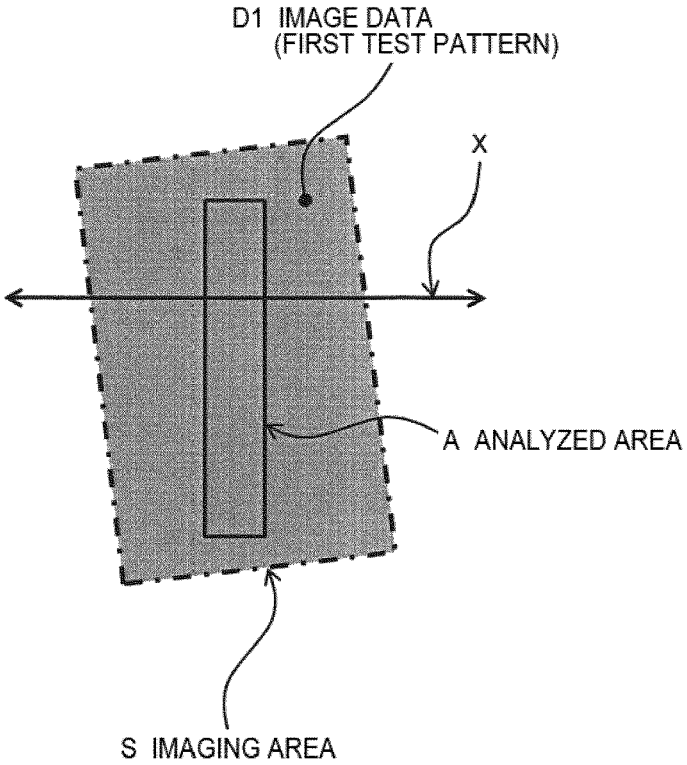
FIG. 7 shows an example of the analyzed area A.

FIG. 7 shows an example of the analyzed area A. In the example in FIG. 7, density data is acquired and transmitted for each pixel in the analyzed area A, but differences in the printing condition can be detected between nozzles by comparing data in the direction perpendicular to the line of data along arrow X. Because one first test pattern M1 is a solid color mark of the same density, there should be no difference in density. As a result, detecting a difference in density shows that printing is uneven.

The part of the controller 21 that controls the printing adjustment function performs this analysis, and if blotchy printing or other printing defect is detected, identifies the nozzles that caused the printing defect, and applies the adjustment process correcting the printing defect, such as adjusting the amount of ink ejected from the offending nozzles. For example, if the density of pixels formed by ink ejected from a specific nozzle is lighter than other pixels, control is applied to increase the applied voltage or the energizing time to increase the amount of ink ejected from the specific nozzle.

The inspection mode is processed as described above. However, instead of executing a process of first determining the rated emittance level for each first test pattern M1, a configuration that adjusts the emittance of the light source 223 when capturing images of the first test patterns M1 so that the maximum amount of light received by the camera 222 is approximately 90% of the maximum amount of receivable light is also conceivable.

Figure 8:
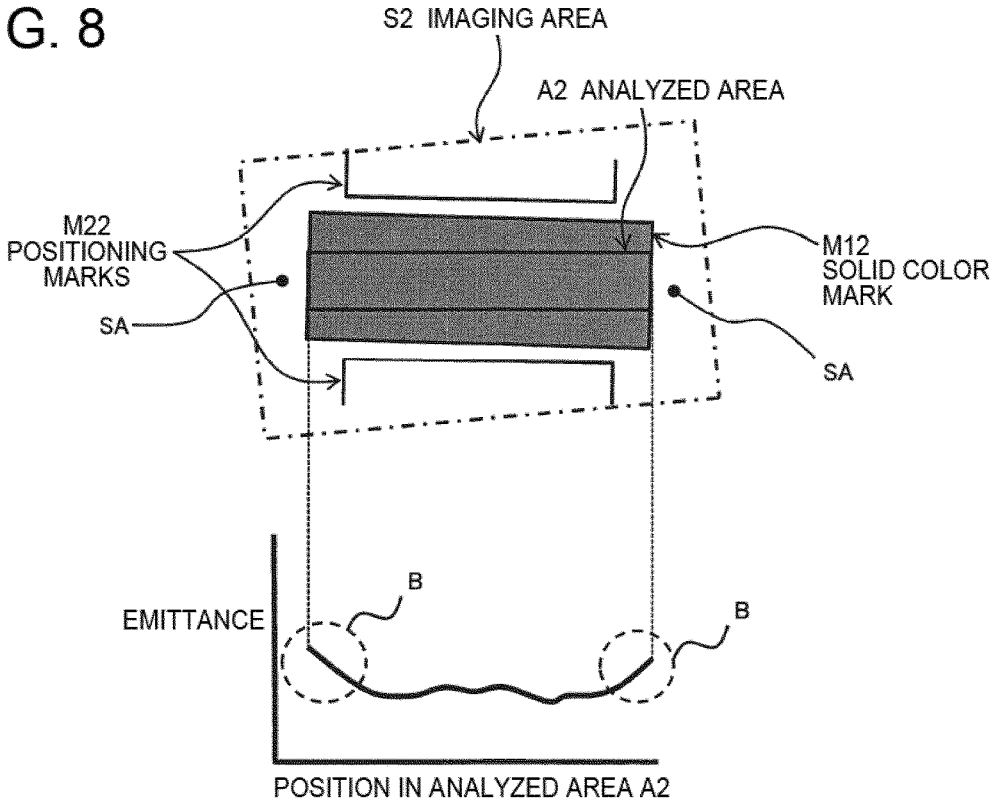
FIG. 8 shows an example of the photographed state of a test pattern when the printer 2 of at least one embodiment of the invention is not used.

An example of the effect of this printer 2 is described next. FIG. 8 shows an example of imaging a test pattern when not using the printer 2 according to this embodiment of the invention. The relative positions of the solid color mark M12, which is the printed test pattern, and positioning marks M22, imaging area S2, and analyzed area A2 are shown on the top in FIG. 8.

In this example, similarly to printing a conventional test pattern, the solid color mark M12 and positioning marks M22 are printed in the same area, and both are imaged at the same time in the imaging area S2 by a camera. In this case, because there is an area (indicated by reference numeral SA in FIG. 8) where the paper, which has higher reflectance, is exposed adjacent to the ends of the analyzed area A2 (the left and right ends in FIG. 8), the amount of light the camera receives in these end areas of the analyzed area A2 is greater than what is actually reflected from the analyzed area A2 because of the effect of light reflected from the adjacent part of the paper.

The relationship between locations in the analyzed area A2 (positions right to left in FIG. 8) and the amount of light received by the camera is shown in the graph on the bottom in FIG. 8. As indicated by B in the figure, that the amount of light received increases at the ends of the analyzed area A2 due to the effect of the adjacent areas SA is obvious. As a result, the actual density of the solid color mark is determined to be lighter than it actually is, cannot be accurately determined, and precise device adjustment is therefore not possible.

Figure 9:
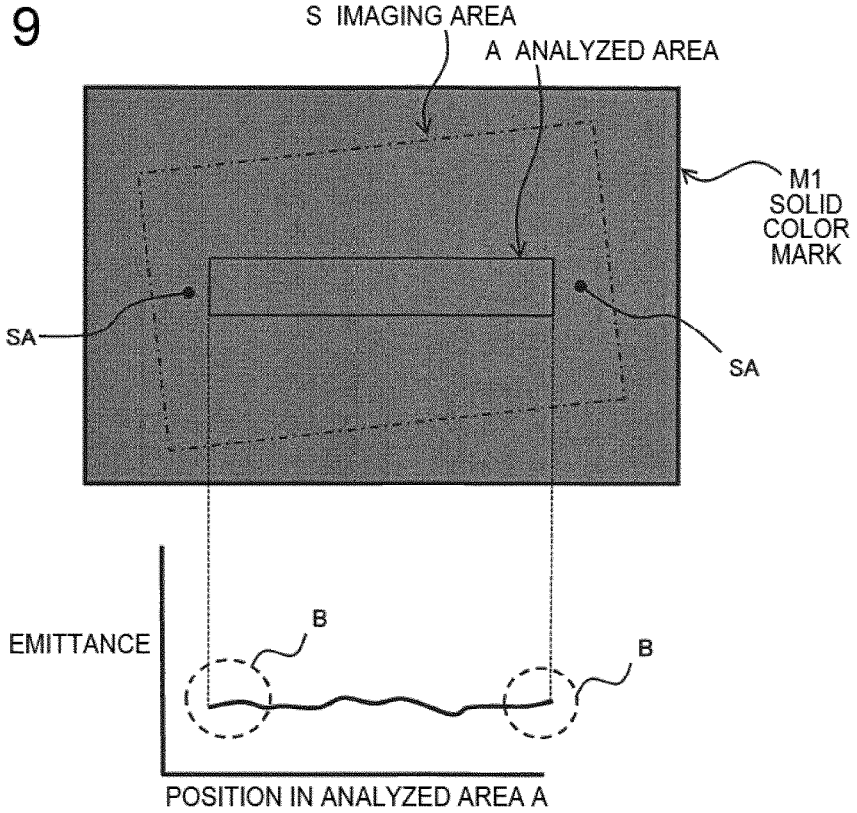
FIG. 9 shows an example of the photographed state of a test pattern when the printer 2 of at least one embodiment of the invention is used.

FIG. 9 shows an example of a test pattern imaged using the printer 2 according to this embodiment of the invention. Shown on the top in FIG. 9 are the relative positions of the solid color mark M1 printed using the printer 2 described above, the imaging area S, and the analyzed area A.

In this case, because the solid color mark M1 is larger than the imaging area S, there is no change in the reflectance of light at the ends of the analyzed area A (the right-left ends in FIG. 9) and the adjacent parts (indicated by the reference numeral SA in FIG. 9), and the adverse effects shown in FIG. 8 are not observed.

The relationship between locations in the analyzed area A (positions right to left in FIG. 9) and the amount of light received by the camera is shown in the graph on the bottom in FIG. 9. As indicated by B in the figure, because there is no effect from the reflectance of light at the ends of the analyzed area A, the problem of the amount of light received being greater than actually reflected from the analyzed area A does not occur. As a result, the printer 2 according to this embodiment of the invention enables high precision imaging by a camera with little error.

As described above, a printer 2 according to this embodiment of the invention has a camera 222 that can photograph images printed by the printhead 221 mounted on the carriage 224, and in the inspection mode, a solid color mark M1 that is imaged by the camera 222 is printed larger than the imaging area S of the camera 222. As a result, the first test pattern M1 can be imaged with high precision without receiving adverse effects at the ends of the imaging area S as described above.

Furthermore, because solid color marks M1 of different density levels are printed separately from a positioning marks M2, and only images of substantially the same density are printed in the imaging area S, the emittance level of the light source 223 can be adjusted (increased) before imaging so that the maximum amount of light received by the camera 222 is close the maximum amount of receivable light. In other words, the emittance level can be adjusted appropriately to the density of the solid color mark M1 to be imaged, and the first test pattern M1 can be imaged with great precision.

Furthermore, because positioning marks M2 are printed and imaged with a camera, and skewing of the solid color mark M1 is adjusted based on image data of the acquired positioning marks M2, printing defects can be detected with great accuracy.

Furthermore, the positioning marks M2 are line marks and skewing is easily detected, and the solid color marks M1 are marks of the same shape printed a solid color at different density levels, suitable for detecting blotchy printing and other printing defects.

Furthermore, by making the solid color marks M1 larger than the area (emittance area) illuminated by the light source 223, adverse effects resulting from reflection of light from outside the solid color marks M1 is suppressed, and even more precise imaging is possible.

Furthermore, because the controller 21 identifies nozzles that are the cause of printing defects (such as blotchy printing), and adjusts the ejection of ink from those nozzles, based on image data corrected for skewing and acquired by accurate imaging, accurate printer calibration can be performed automatically.

Note that the invention can be applied to printers that print by printing methods other than inkjet.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:

a printhead configured to print to a print medium;

a camera configured to photograph the print medium;

a light source disposed configured to emit a specific amount of light to an imaging area of the camera;

a carriage configured to support and move the printhead, the camera, and the light source; and a processor configured to control the printhead to print, on the print medium, a first test pattern that is larger than an imaging area of the camera, to set the specific amount of light from the light source so that a maximum amount of light reflected from the first test pattern does not exceed a maximum amount of light that is receivable by the camera, to control the camera to photograph the first test pattern, and to detect a printing defect based on a result of the photograph.

2. The printer described in claim 1, wherein:

the first test pattern is larger than an area illuminated by the light source.

3. The printer described in claim 1, wherein:

the processor is configured to control the printhead to print, on the print medium, a second test pattern at a position separated a specific distance from the first test pattern, to photograph the second test pattern using the camera, and to correct skewing of the first test pattern based on a result of the photograph.

4. The printer described in claim 3, wherein:

the first test pattern comprises a specific pattern printed repeatedly, and the second test pattern comprises a line mark printed at a specific interval.

5. The printer described in claim 3, wherein:

the processor is configured to control the printhead to print part of the first test pattern and the second test pattern in the same pass when the printhead moves in a scanning direction.

6. The printer described in claim 1, wherein:

the processor is configured to identify a nozzle of the printhead and is a cause of the detected printing defect, and to adjust an amount of ink ejected from the identified nozzle.

7. A method of controlling a printer comprising a printhead configured to print to a print medium, a camera configured to photograph the print medium, a light source disposed configured to emit a specific amount of light to an imaging area of the camera, and a carriage configured to support and move the printhead, the camera, and the light source, the control method comprising:

controlling the printhead to print, on the print medium, a first test pattern that is larger than an imaging area of the camera;

setting the specific amount of light from the light source so that a maximum amount of light reflected from the first test pattern does not exceed a maximum amount of light that is receivable by the camera;

controlling the camera to photograph the first test pattern using the camera; and detecting a printing defect based on a result of the photograph.

8. The control method described in claim 7, wherein:

the first test pattern is larger than an area illuminated by the light source.

9. The control method described in claim 7, further comprising:

controlling the printhead to print, on the print medium, a second test pattern at a position separated a specific distance from the first test pattern, controlling the camera to photograph the second test pattern, and correcting skewing of the first test pattern based on a result of the photograph.

10. The control method described in claim 9, wherein:

the first test pattern comprises a specific pattern printed repeatedly, and the second test pattern comprises a line mark printed at a specific interval.

11. The control method described in claim 9, wherein:

the printhead is controlled such that part of the first test pattern and the second test pattern are printed in the same pass when the printhead moves in a scanning direction.

12. The control method described in claim 7, further comprising:

identifying a nozzle disposed to the printhead that is a cause of the detected printing defect, and adjusting an amount of ink ejected from the identified nozzle.

* * * * *